US006422169B1

(12) United States Patent
Schwantes

(10) Patent No.: US 6,422,169 B1
(45) Date of Patent: Jul. 23, 2002

(54) BOAT MOORING DEVICE

(76) Inventor: Mary E. Schwantes, 857 Forest Cir., Fond du Lac, WI (US) 54935

( * ) Notice: Subject to any disclaimer, the term of this patent is extended or adjusted under 35 U.S.C. 154(b) by 0 days.

(21) Appl. No.: 09/881,962

(22) Filed: Jun. 15, 2001

(51) Int. Cl.[7] ..... B63B 21/00
(52) U.S. Cl. ..... 114/230.19
(58) Field of Search ..... 114/230.1, 230.15, 114/230.19, 230.17, 230.18

(56) References Cited

U.S. PATENT DOCUMENTS

| | | | | | |
|---|---|---|---|---|---|
| 1,094,610 | A | * | 4/1914 | Steinhauer | 114/230.18 |
| 2,930,339 | A | * | 3/1960 | Trnka | 114/230.15 |
| 3,019,759 | A | * | 2/1962 | Woods | 114/230.17 |
| 3,139,852 | A | * | 7/1964 | Morris | 114/230.18 |
| 3,142,284 | A | * | 7/1964 | Kauffman | 114/230.15 |
| 3,177,839 | A | * | 4/1965 | Nolf | 114/230.18 |
| 3,828,716 | A | * | 8/1974 | Bernardi | 114/230.15 |
| 4,144,831 | A | | 3/1979 | Heydolph | |
| 4,459,930 | A | | 7/1984 | Flory | |
| 4,686,926 | A | * | 8/1987 | Vance | 114/230.18 |
| 4,697,538 | A | | 10/1987 | Day | |
| 4,771,719 | A | * | 9/1988 | Chlebowski | 114/230.1 |
| 4,781,138 | A | * | 11/1988 | Hay | 114/230.17 |
| 5,014,638 | A | | 5/1991 | Ilves et al. | |
| D317,896 | S | | 7/1991 | Oslund | |
| 5,243,926 | A | * | 9/1993 | Wright et al. | 114/230.19 |
| 5,408,946 | A | * | 4/1995 | Jones et al. | 114/230.17 |
| 5,671,693 | A | | 9/1997 | Robinson | |

* cited by examiner

*Primary Examiner*—S. Joseph Morano
*Assistant Examiner*—Lars A. Olson

(57) ABSTRACT

A boat mooring device for releasably securing a boat to a dock includes a sleeve which is elongated and has a first open end and a second open end. A pair of legs is attached to the sleeve and extend away from the sleeve in the general direction of the second open end. A pair of brackets removably secure the legs to a dock. An elongated rod has a length greater than the sleeve and is extendable through the sleeve. The rod has a first end and a second end. A pair of biasing members are positioned on the and bias the ends of the rod from a respectively adjacent end of the sleeves. A securing member for removably secures the first end of the rod to a boat.

8 Claims, 3 Drawing Sheets

BOAT MOORING DEVICE

BACKGROUND OF THE INVENTION

1. Field of the Invention

The present invention relates to mooring devices and more particularly pertains to a new boat mooring device for releasably securing a boat to a dock.

2. Description of the Prior Art

The use of mooring devices is known in the prior art. More specifically, mooring devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,697,538; U.S. Pat. No. 5,671,693; U.S. Pat. No. 5,014,638; U.S. Patent No. 4,144,831; U.S. Pat. No. 4,459,930; and U.S. Pat. No. 317,896.

While these devices fulfill their respective, particular objectives and requirements, the aforementioned patents do not disclose a new boat mooring device. The inventive device includes a sleeve which is elongated and has a first open end and a second open end. Each of the first and second ends has an annular lip thereon. A pair of legs is attached to the sleeve and extend away from the sleeve in the general direction of the second open end. A pair of brackets removably secure the legs to a dock. An elongated rod has a length greater than the sleeve and is extendable through the sleeve. The rod has a first end and a second end each having a flange thereon. A first biasing member is positioned on the rod between the first open end of the sleeve and the first end of the rod. A second biasing member is positioned on the rod between the second open end of the sleeve and the second end of the rod. The biasing members bias the ends of the rod from a respectively adjacent end of the sleeves. A securing member for removably secures the first end of the rod to a boat.

In these respects, the boat mooring device according to the present invention substantially departs from the conventional concepts and designs of the prior art, and in so doing provides an apparatus primarily developed for the purpose of releasably securing a boat to a dock.

SUMMARY OF THE INVENTION

In view of the foregoing disadvantages inherent in the known types of mooring devices now present in the prior art, the present invention provides a new boat mooring device construction wherein the same can be utilized for releasably securing a boat to a dock.

The general purpose of the present invention, which will be described subsequently in greater detail, is to provide a new boat mooring device apparatus and method which has many of the advantages of the mooring devices mentioned heretofore and many novel features that result in a new boat mooring device which is not anticipated, rendered obvious, suggested, or even implied by any of the prior art mooring devices, either alone or in any combination thereof.

To attain this, the present invention generally comprises a sleeve which is elongated and has a first open end and a second open end. Each of the first and second ends has an annular lip thereon. A pair of legs is attached to the sleeve and extend away from the sleeve in the general direction of the second open end. A pair of brackets removably secure the legs to a dock. An elongated rod has a length greater than the sleeve and is extendable through the sleeve. The rod has a first end and a second end each having a flange thereon. A first biasing member is positioned on the rod between the first open end of the sleeve and the first end of the rod. A second biasing member is positioned on the rod between the second open end of the sleeve and the second end of the rod. The biasing members bias the ends of the rod from a respectively adjacent end of the sleeves. A securing member for removably secures the first end of the rod to a boat.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new boat mooring device apparatus and method which has many of the advantages of the mooring devices mentioned heretofore and many novel features that result in a new boat mooring device which is not anticipated, rendered obvious, suggested, or even implied by any of the prior art mooring devices, either alone or in any combination thereof.

It is another object of the present invention to provide a new boat mooring device which may be easily and efficiently manufactured and marketed.

It is a further object of the present invention to provide a new boat mooring device which is of a durable and reliable construction.

An even further object of the present invention is to provide a new boat mooring device which is susceptible of a low cost of manufacture with regard to both materials and labor, and which accordingly is then susceptible of low prices of sale to the consuming public, thereby making such boat mooring device economically available to the buying public.

Still yet another object of the present invention is to provide a new boat mooring device which provides in the apparatuses and methods of the prior art some of the advantages thereof, while simultaneously overcoming some of the disadvantages normally associated therewith.

Still another object of the present invention is to provide a new boat mooring device for releasably securing a boat to a dock.

Yet another object of the present invention is to provide a new boat mooring device which includes a sleeve which is elongated and has a first open end and a second open end. Each of the first and second ends has an annular lip thereon. A pair of legs is attached to the sleeve and extend away from the sleeve in the general direction of the second open end. A pair of brackets removably secure the legs to a dock. An elongated rod has a length greater than the sleeve and is extendable through the sleeve. The rod has a first end and a second end each having a flange thereon. A first biasing member is positioned on the rod between the first open end of the sleeve and the first end of the rod. A second biasing member is positioned on the rod between the second open end of the sleeve and the second end of the rod. The biasing members bias the ends of the rod from a respectively adjacent end of the sleeves. A securing member for removably secures the first end of the rod to a boat.

Still yet another object of the present invention is to provide a new boat mooring device that uses biasing members to cushion the movement of the boat.

Even still another object of the present invention is to provide a new boat mooring device that ensures the boat will not strike the dock.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
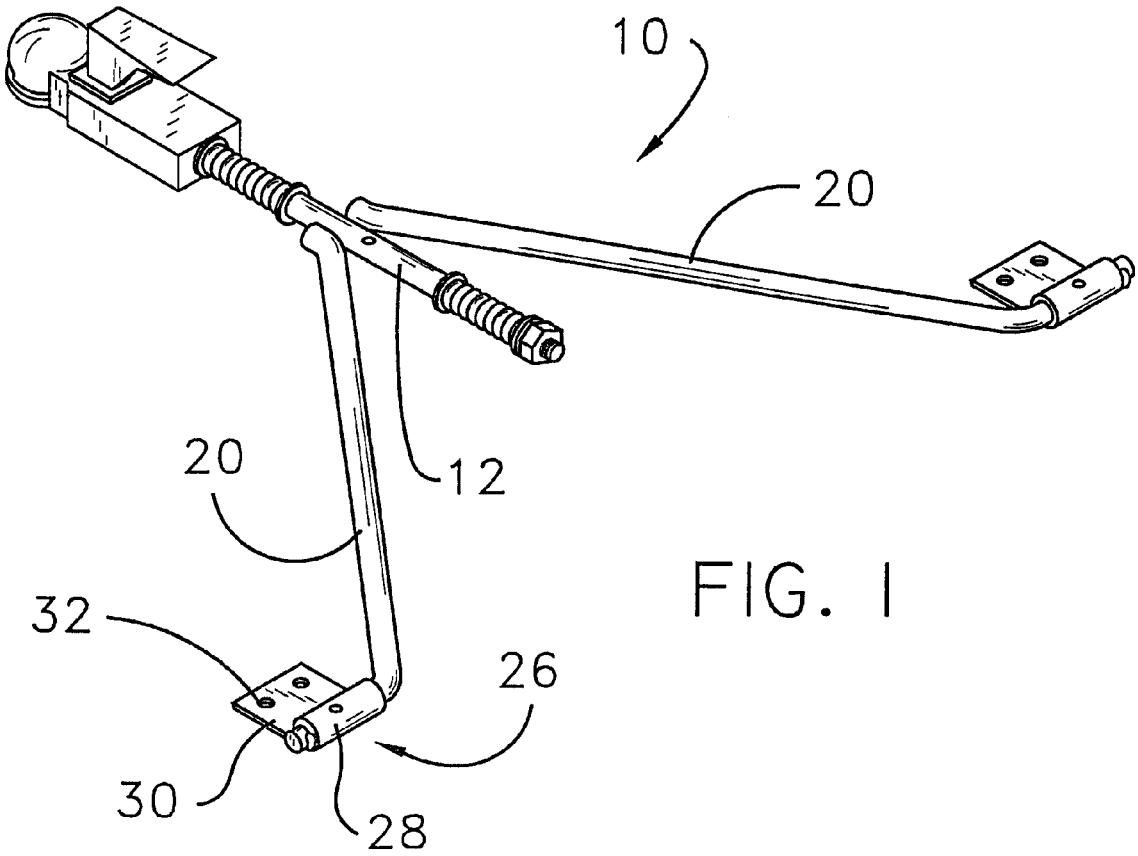
FIG. 1 is a schematic perspective view of a new boat mooring device according to the present invention.
Figure 3:
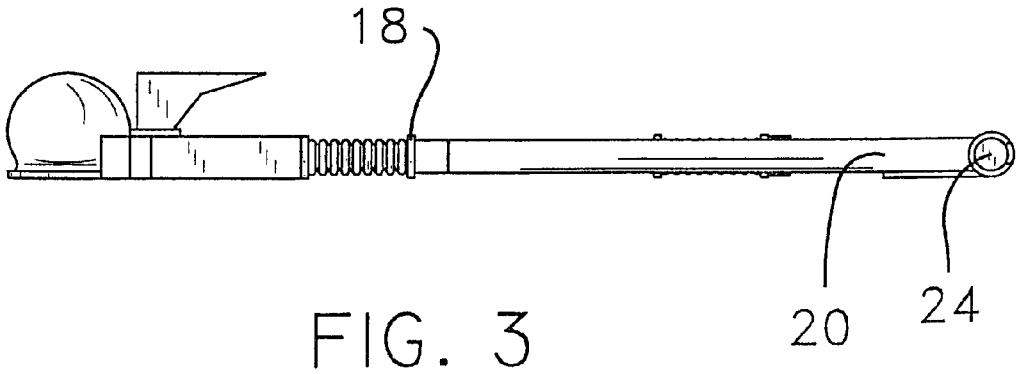
FIG. 3 is a schematic side view of the present invention.
Figure 2:
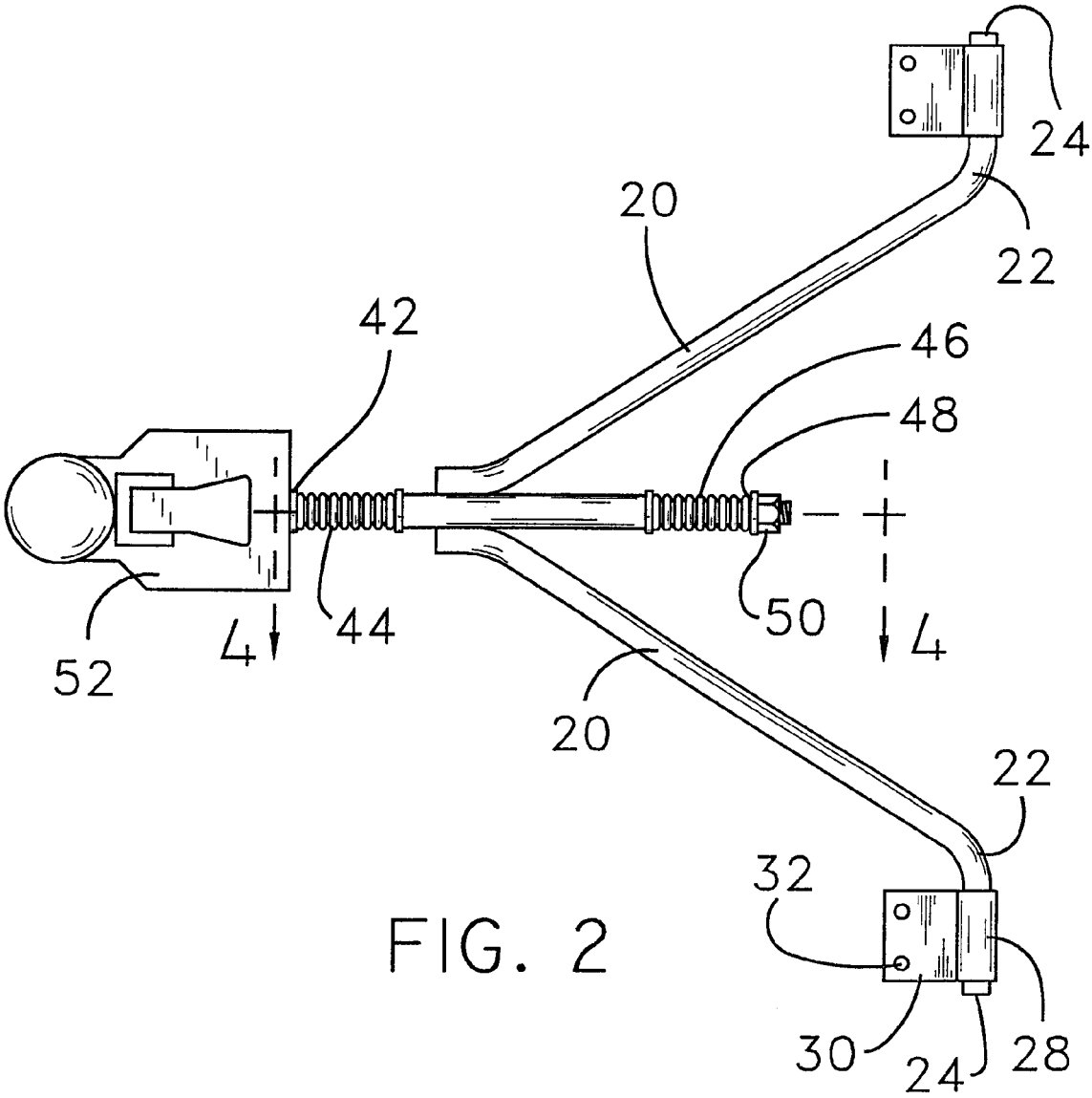
FIG. 2 is a schematic plan view of the present invention.
Figure 4:
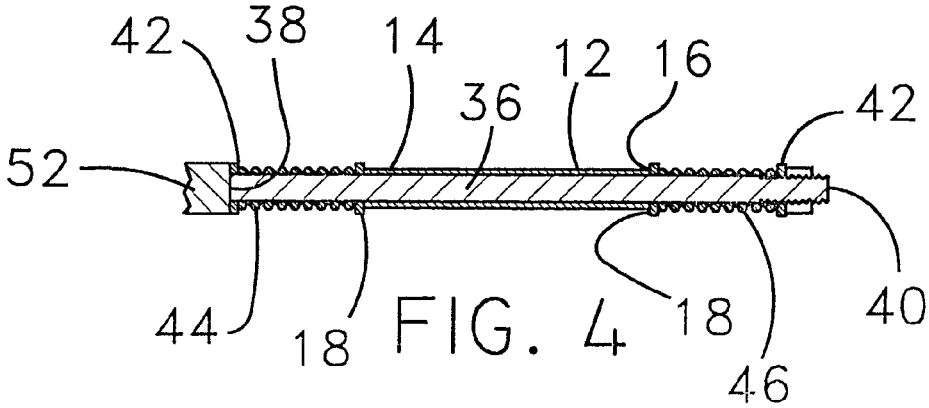
FIG. 4 is a schematic cross-sectional view taken along line 4—4 of the present invention.
Figure 5:
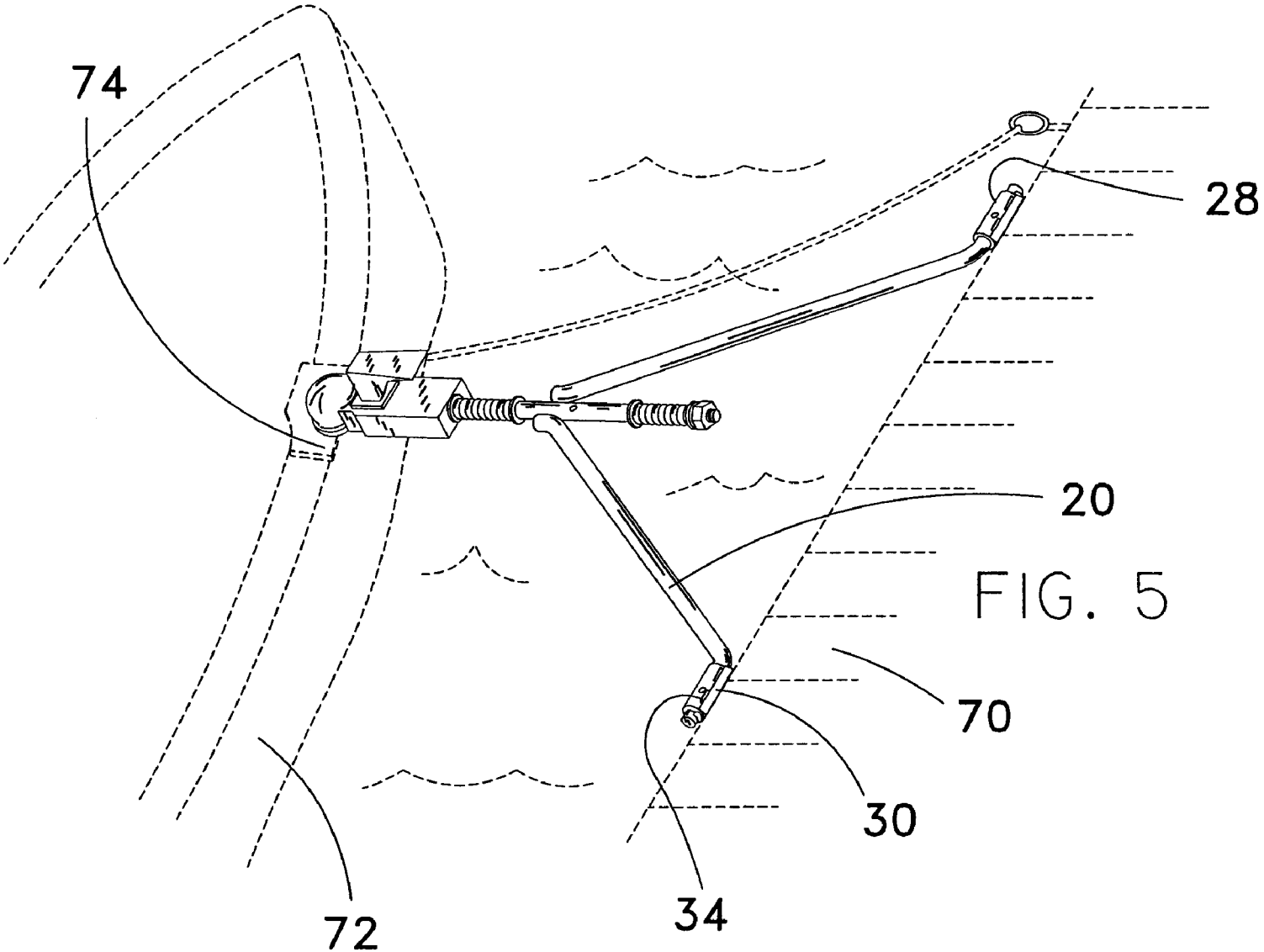
FIG. 5 is a schematic in-use view of the present invention.

With reference now to the drawings, and in particular to FIGS. 1 through 5 thereof, a new boat mooring device embodying the principles and concepts of the present invention and generally designated by the reference numeral 10 will be described.

As best illustrated in FIGS. 1 through 5, the boat mooring device 10 generally comprises a sleeve 12 which is elongated and has a first open end 14 and a second open end 16. Each of the first 14 and second 16 ends of the sleeve 12 has an annular lip 18 thereon. A pair of legs 20 is attached to the sleeve 12. Each of the legs 20 extends away from the sleeve 12 in the general direction of the second open end 16 such than an angle formed by the legs 20 is generally between 90 degrees and 75 degrees. The sleeve 12 and the legs 20 generally lie within a plane. Each of the legs 20 has a bend 22 therein such that free ends 24 of the legs 20 extend away from each other.

A pair of brackets 26 removably secures the legs 20 to a dock 70. Each of the brackets 26 is rotatably attached to one of the legs 20 and is positioned between the bend 22 and the free end 24 of the legs 20. The brackets 26 each include a cylindrical member 28 for extending one of the free ends 24 of the legs 20 through. Each of a pair of plates 30 is attached to one of the cylindrical members 28. The plates 30 each have a plurality of apertures 32 extending therethrough. Each of a plurality of mechanical fasteners 34 may be extended through one of the apertures 32 and into the dock 70. The mechanical fasteners 34 may include nails, bolts or screws.

An elongated rod 36 has a length greater than the sleeve 12 is extendable through the sleeve 12. The rod 36 has a first end 38 and a second end 40. Each of the first 38 and second 40 ends has a flange 42 thereon. A first biasing member 44 is positioned on the rod 30 between the first open end 14 of the sleeve 12 and the first end 38 of the rod 36. A second biasing member 46 is positioned on the rod 36 between the second open end 40 of the sleeve 12 and the second end 40 of the rod 36. The biasing members 44, 46 bias the ends of the rod 36 from a respectively adjacent end of the sleeve 12. Each of the biasing members 44, 46 comprises a spring extending between and abutting one of the lips 18 and the flanges 42. The flange 42 on the second end 40 may be formed by a washer 48 being held by a nut 50. The nut 50 may be tightened to increase the tension on the biasing members 44, 46.

A securing member 52 removably secures the first end 38 of the rod 36 to a boat 72. Ideally, the securing member 52 comprises a ball hitch, though other conventional securing members are envisioned.

In use, the device 10 is attached to a dock 70. The ball portion 74 of a ball and ball hitch combination is attached to a boat 72 in the location desired by the user. The ball hitch 52 is then secured to the ball 74 to moor the boat 72 to the dock 70. The biasing members 44, 46 act as a cushion and allow movement of the boat without allowing the boat 72 to strike the dock 72.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A mooring device for removably holding a boat to a dock, said device comprising:

a sleeve being elongated and having a first open end and a second open end, each of said first and second ends having an annular lip thereon; a pair of legs being attached to said sleeve, each of said legs extending away from said sleeve in the general direction of said second open end;

a pair of brackets removably secure said legs to the dock;

an elongated rod having a length greater than said sleeve being extendable through said sleeve, said rod having a first end and a second end, each of said first and second ends having a flange thereon, a first biasing member being positioned on said rod between said first open end of said sleeve and said first end of said rod, a second biasing member being positioned on said rod between said second open end of said sleeve and said second end of said rod, said biasing members biasing said ends of said rod from a respectively adjacent end of said sleeves; and a securing member for removably securing said first end of said rod to the boat.

2. The mooring device as in claim 1, wherein an angle formed by said legs is generally between 90 degrees and 75 degrees.

3. The mooring device as in claim 2, wherein said sleeve and said legs generally lie within a plane.

4. The mooring device as in claim 1, wherein each of said legs has a bend therein such that free ends of said legs are extending away from each other, each of said brackets being rotatably attached to one of said legs and being positioned between said bend and said free end of said legs.

5. The mooring device as in claim 4, wherein each of said brackets includes a cylindrical member for extending one of said free ends of said legs through, each of a pair of plates being attached to one of said cylindrical members, each of said plates having a plurality of apertures extending therethrough, wherein each of a plurality of mechanical fasteners may be extended through one of said apertures and into the dock.

6. The mooring device as in claim 1, wherein each of said biasing members comprises a spring extending between and abutting one of said lips and said flanges.

7. The mooring device as in claim 1, wherein said securing member comprises a ball hitch.

8. A mooring device for removably holding a boat to a dock, said device comprising:

a sleeve being elongated and having a first open end and a second open end, each of said first and second ends having an annular lip thereon; a pair of legs being attached to said sleeve, each of said legs extending away from said sleeve in the general direction of said second open end such than an angle formed by said legs is generally between 90 degrees and 75 degrees, said sleeve and said legs generally lying within a plane, each of said legs having a bend therein such that free ends of said legs are extending away from each other;

a pair of brackets removably secure said legs to the dock, each of said brackets being rotatably attached to one of said legs and being positioned between said bend and said free end of said legs, each of said brackets including a cylindrical member for extending one of said free ends of said legs through, each of a pair of plates being attached to one of said cylindrical members, each of said plates having a plurality of apertures extending therethrough, wherein each of a plurality of mechanical fasteners may be extended through one of said apertures and into the dock;

an elongated rod having a length greater than said sleeve being extendable through said sleeve, said rod having a first end and a second end, each of said first and second ends having a flange thereon, a first biasing member being positioned on said rod between said first open end of said sleeve and said first end of said rod, a second biasing member being positioned on said rod between said second open end of said sleeve and said second end of said rod, said biasing members biasing said ends of said rod from a respectively adjacent end of said sleeve, each of said biasing members comprising a spring extending between and abutting one of said lips and said flanges; and a securing member for removably securing said first end of said rod to the boat, said securing member comprising a ball hitch.

* * * * *